US006948454B2

(12) United States Patent
Hughes et al.

(10) Patent No.: US 6,948,454 B2
(45) Date of Patent: Sep. 27, 2005

(54) AIRFLOW APPARATUS

(75) Inventors: Dennis R. Hughes, Hartford, WI (US); Christopher P. Flanner, Elm Grove, WI (US); Kevin M. Field, Oconomowoc, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 10/842,098

(22) Filed: May 10, 2004

(65) Prior Publication Data

US 2004/0206311 A1 Oct. 21, 2004

Related U.S. Application Data

(63) Continuation of application No. 10/410,759, filed on Apr. 10, 2003, now Pat. No. 6,745,724, which is a continuation-in-part of application No. 09/920,907, filed on Aug. 2, 2001, now Pat. No. 6,557,501.

(51) Int. Cl.[7] ..... F22B 9/18

(52) U.S. Cl. ..... 122/44.2; 122/155.1

(58) Field of Search ..... 432/37, 39, 201; 122/44.2, 14.1, 18.3, 14.31, 155.1, 155.2, 14.2, 14.21

(56) References Cited

U.S. PATENT DOCUMENTS

| | | | |
|---|---|---|---|
| 3,638,058 | A | 1/1972 | Fritzius |
| 3,699,387 | A | 10/1972 | Edwards |
| 4,231,766 | A | 11/1980 | Spurgin |
| 4,265,394 | A | 5/1981 | Nagel |
| 4,485,746 | A | 12/1984 | Erlandsson |
| 4,531,509 | A | 7/1985 | Wilhelm, Jr. |
| 4,643,745 | A | 2/1987 | Sakakibara et al. |
| 4,672,919 | A | 6/1987 | Staats |
| 4,689,056 | A | 8/1987 | Noguchi et al. |
| 4,757,802 | A | 7/1988 | Guzorek |
| 4,770,160 | A | 9/1988 | Schimmeyer |
| 4,773,385 | A | 9/1988 | Gatling |
| 4,789,801 | A | 12/1988 | Lee |
| 4,812,711 | A | 3/1989 | Torok et al. |
| 4,867,106 | A | 9/1989 | Staats |
| 4,907,737 | A | 3/1990 | Williams, Jr. |

(Continued)

FOREIGN PATENT DOCUMENTS

| | | |
|---|---|---|
| EP | 0 016 479 A2 | 1/1980 |

*Primary Examiner*—Gregory Wilson
(74) *Attorney, Agent, or Firm*—Michael Best & Friedrich LLP

(57) ABSTRACT

An apparatus for heating a medium includes a combustion chamber; a burner within the combustion chamber and operable to create products of combustion for heating the medium to be heated; a conduit for the exhaust of the products of combustion; and an airflow apparatus capable of creating airflow in the absence of any opposition to the airflow, the airflow having a pressure, the airflow apparatus communicating with the conduit and operable such that the pressure of the airflow resists standby convection flow of gases out of the conduit when the burner is not operating, and wherein the airflow apparatus is adjustable to vary the magnitude of the airflow to substantially equalize the airflow and the standby convection flow of gases to create a substantially stagnant state within the conduit when the burner is not operating.

19 Claims, 5 Drawing Sheets

U.S. PATENT DOCUMENTS

| | | | | | |
|---|---|---|---|---|---|
| 4,953,510 | A | | 9/1990 | Akkala et al. | |
| 5,006,761 | A | | 4/1991 | Torok et al. | |
| 5,012,159 | A | | 4/1991 | Torok et al. | |
| 5,077,500 | A | | 12/1991 | Torok et al. | |
| 5,180,404 | A | | 1/1993 | Loreth et al. | |
| 5,222,476 | A | | 6/1993 | Chmielewski | |
| 5,239,947 | A | | 8/1993 | Schimmeyer | |
| 5,255,665 | A | | 10/1993 | Windon | |
| RE34,534 | E | | 2/1994 | Staats | |
| 5,443,040 | A | * | 8/1995 | Kaji et al. | 203/22 |
| 5,495,829 | A | | 3/1996 | Jayaraman et al. | |
| 5,524,556 | A | | 6/1996 | Rowlette et al. | |
| 5,616,995 | A | | 4/1997 | Hollenbeck | |
| 5,676,069 | A | | 10/1997 | Hollenbeck | |
| 5,680,021 | A | | 10/1997 | Hollenbeck | |
| 5,697,330 | A | | 12/1997 | Yetman et al. | |
| 5,720,231 | A | | 2/1998 | Rowlette et al. | |
| 5,791,332 | A | | 8/1998 | Thompson et al. | |
| 5,806,440 | A | | 9/1998 | Rowlette et al. | |
| 5,845,632 | A | | 12/1998 | Schimmeyer | |
| 5,878,699 | A | * | 3/1999 | Barnett et al. | 122/1 A |
| 5,899,666 | A | | 5/1999 | Chung et al. | |
| 5,911,217 | A | | 6/1999 | Dameworth et al. | |
| 5,941,230 | A | | 8/1999 | Rutz et al. | |
| 5,982,102 | A | | 11/1999 | Andrzej | |
| 6,000,391 | A | | 12/1999 | Timmons | |
| 6,053,130 | A | | 4/2000 | Shellenberger | |
| 6,112,741 | A | | 9/2000 | Stickford et al. | |
| RE37,389 | E | | 9/2001 | Rutz et al. | |
| 6,401,669 | B1 | | 6/2002 | Macgowan et al. | |
| 6,418,882 | B1 | | 7/2002 | Trant et al. | |
| 6,622,660 | B1 | | 9/2003 | Bajic et al. | |
| 2002/0100471 | A1 | | 8/2002 | Halgash et al. | |

* cited by examiner

AIRFLOW APPARATUS

CROSS-REFERENCE TO RELATED APPLICATIONS

This application is a continuation of U.S. application Ser. No. 10/410,759 filed Apr. 10, 2003 now U.S. Pat. No. 6,745,724, which is a continuation-in-part of U.S. application Ser. No. 09/920,907 filed Aug. 2, 2001 now U.S. Pat. No. 6,557,501. The entire contents of both prior patent applications are hereby incorporated by reference.

BACKGROUND

It is known to use a damper in a water heater flue. Known dampers use a physical obstruction to close the flue during standby. One example of a physical obstruction type damper is disclosed in U.S. Pat. No. 4,953,510.

SUMMARY

The invention provides an apparatus for heating a medium. The apparatus comprises a combustion chamber; a burner within the combustion chamber and operable to create products of combustion for heating the medium to be heated; a conduit for the exhaust of the products of combustion; and an airflow apparatus. The airflow apparatus is capable of creating airflow in the absence of any opposition to the airflow, the airflow having a pressure, the airflow apparatus communicating with the conduit and operable such that the pressure of the airflow resists standby convection flow of gases out of the conduit when the burner is not operating. The airflow apparatus is adjustable to vary the magnitude of the airflow to substantially equalize the airflow and the standby convection flow of gases to create a substantially stagnant state within the conduit when the burner is not operating.

In one embodiment, for example, the apparatus for heating a medium may include a water tank. In such an embodiment, the medium to be heated may be water in the water tank, and the conduit may include a flue extending vertically through the water tank such that the hot products of combustion heat the water through the flue walls.

In some embodiments, the airflow apparatus may include first and second electrodes having opposite polarities and spaced from each other. The apparatus may also include a power source interconnected between the first and second electrodes to create a voltage difference between the first and second electrodes. The first electrode creates ions that are biased for movement toward the second electrode to generate the airflow. The magnitude of the airflow may be varied by adjusting the voltage difference.

In some embodiments, the airflow apparatus may be operable to create a second airflow having a second pressure, and the second pressure may assist the flow of gases out of the conduit when the burner is operating. The apparatus may also include a catalytic converter communicating with the conduit. The second airflow may mix into the products of combustion air from a source of air to increase the effectiveness of the catalytic converter.

Other features and advantages of the invention will become apparent to those skilled in the art upon review of the following detailed description, claims, and drawings.

Figure 1:
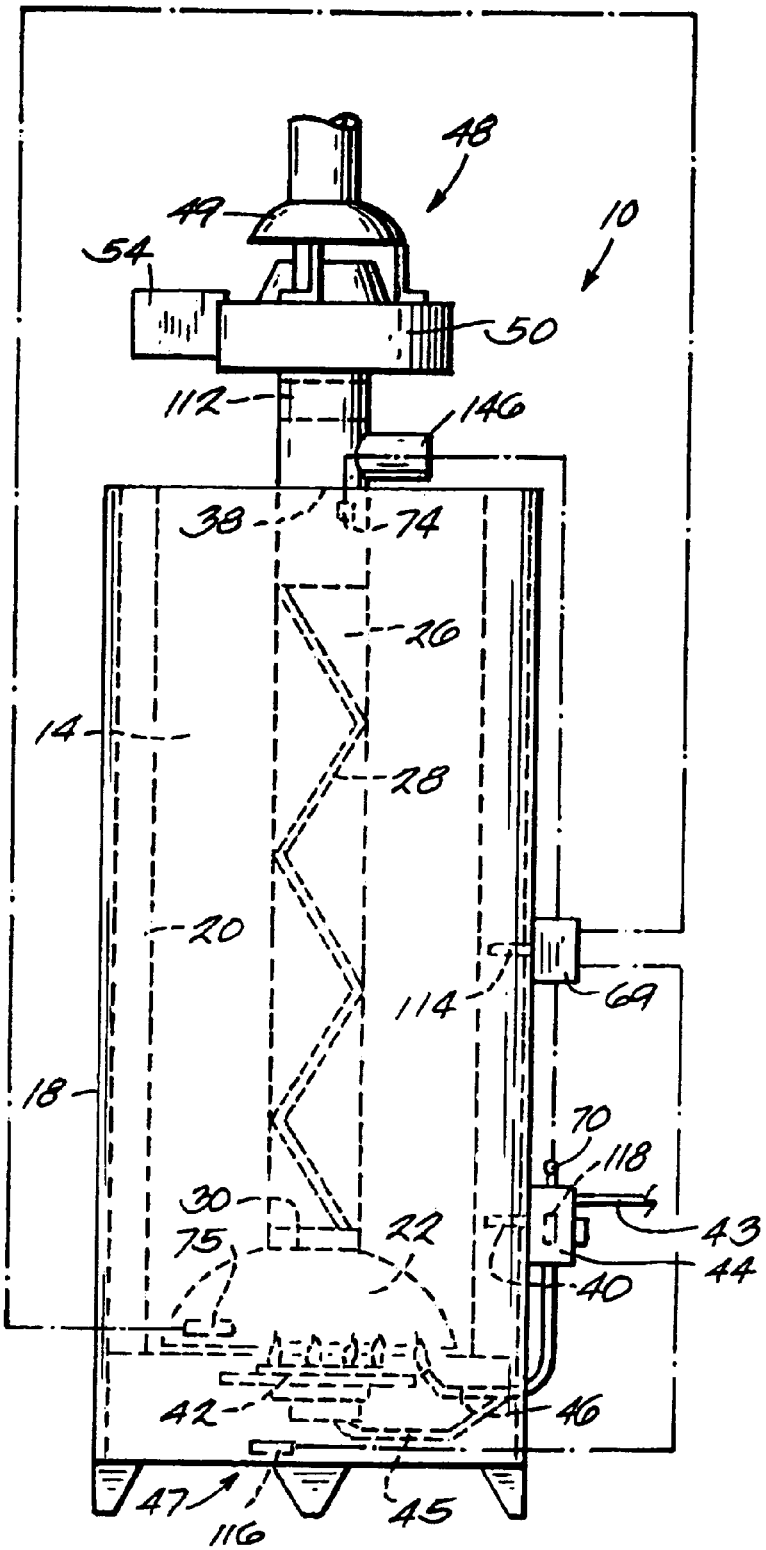
FIG. 1 is a side elevation view of a water heater according to a first embodiment of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

FIG. 1 illustrates a water heater 10 embodying the invention. The water heater 10 comprises a tank 14 for containing water to be heated, an outer jacket 18 surrounding the water tank 14, insulation 20 between the tank 14 and the jacket 18, a combustion chamber 22 below the tank 14, a flue 26 extending substantially vertically through the water tank 14, and a baffle 28 extending through the flue 26. The water heater 10 can also include an optional catalytic converter 112 in communication with the flue 26. The flue 26 includes a first or lower end 30, and a second or upper end 38. The water heater 10 also includes a thermostat 40 extending into the water tank 14 and a burner 42 in the combustion chamber 22. Fuel is supplied to the burner 42 through a fuel line 43, a gas valve 44, and a gas manifold tube 45. The fuel line 43 also provides fuel to a pilot burner 46 next to the burner 42. The pilot burner 46 ignites fuel flowing out of the burner 42 when the burner 42 is activated. The pilot burner 46 may be continuous such as a small flame or intermittent such as an electric spark ignitor (not shown).

In operation, the burner 42 burns the fuel supplied by the fuel line 43, along with air drawn into the combustion chamber 22 through one or more air inlets 47. The burner 42 creates products of combustion that rise through the flue 26 and heat the water by conduction through the flue walls. The flow of products of combustion is driven by natural convection, but may alternatively be driven by a blower unit (not shown) communicating with the flue 26. The above-described water heater 10 is well known in the art.

During standby of the water heater 10 (i.e., when the burner 42 is not operating), the air and other gases in the flue 26 (collectively, "flue gases") are heated by the water in the tank 14 and by the flame of the pilot burner 46. This creates natural convection currents and imparts a buoyancy to the flue gases that causes the flue gases to flow toward the upper end 38 of the flue 26. As used herein, "standby convection" means the natural convection within the flue 26 that occurs when the burner 42 is not operating, and that is caused by the water in the tank 14 and/or the flame of the pilot burner 46 warming the flue gases by heat transfer through the flue walls. Unrestricted flow of warm flue gases out of the flue 26 due to standby convection will result in standby heat loss from the water heater 10.

Figure 2:
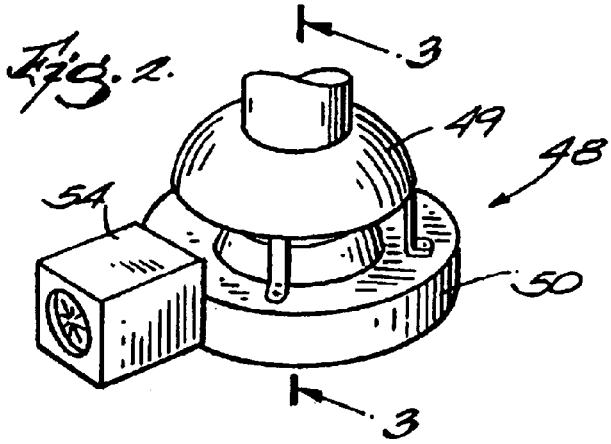
FIG. 2 is a perspective view of a first construction of an airflow apparatus of the water heater shown in FIG. 1.
Figure 3:
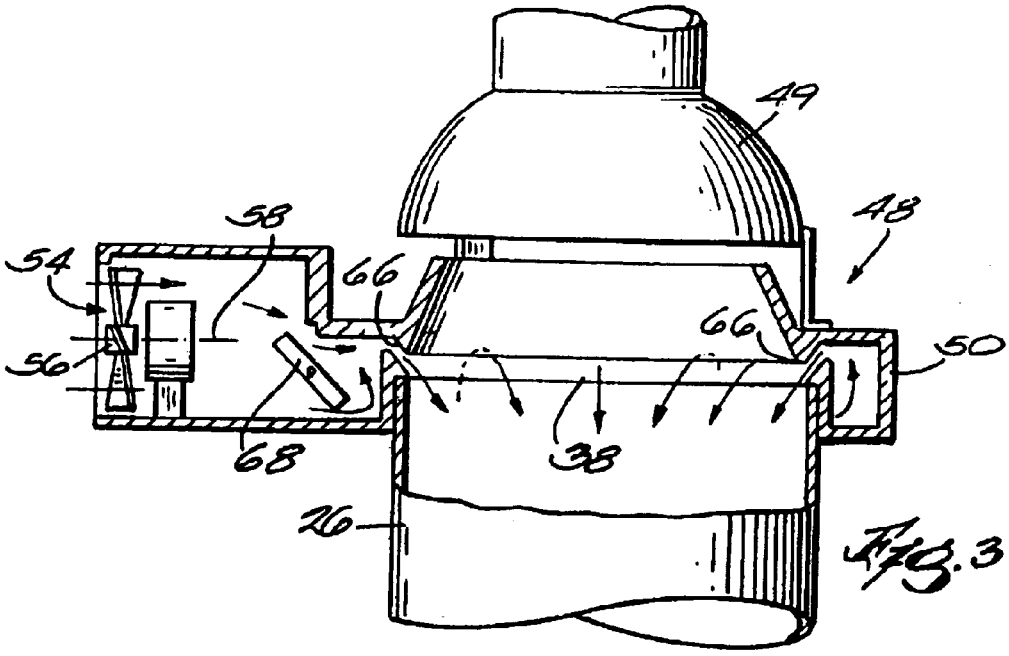
FIG. 3 is a cross-sectional view taken along line 3—3 in FIG. 2.

As seen in FIGS. 1–3, to help reduce or eliminate standby convection heat losses, the water heater 10 includes a novel damper assembly 48. The damper assembly 48 includes a hood 49, a housing 50, and an airflow apparatus 54. The hood 49 permits ambient air to mix with the products of combustion as the products of combustion pass through the damper assembly 48, and before the products of combustion are vented to the atmosphere.

As used herein, the term "airflow apparatus" means an apparatus capable of creating airflow in the absence of any opposition to the airflow. The apparatus 54 includes a tubeaxial fan 56 having rotatable blades that create a flow of air parallel to an axis of rotation 58 of the fan blades. The axis of rotation 58 is disposed horizontally, and the fan 56 is exposed to the ambient air surrounding the water heater 10 such that air is drawn into the damper assembly 48 substantially along the axis of rotation 58. The housing 50 defines an annular cavity surrounding the upper end 38 of the flue 26. Circumferential slots or apertures 66 are provided in the annular cavity, and the slots 66 are preferably angled down to direct airflow out of the annular cavity into the upper end 38 of the flue 26. With some modifications to the housing 50, the tubeaxial fan 56 may be replaced with a radial fan.

The fan 56 is preferably turned on during water heater standby, when the burner 42 is not operating. The fan 56 creates a downward pressure or back pressure zone over or within the upper end 38 of the flue 26. The fan 56 and the standby convection currents create countervailing downward and upward pressures, respectively, within the flue 26. In other words, in the absence of the fan 56, standby convection would cause the flue gases to move vertically upward out of the upper end 38 of the flue 26. In the absence of standby convection, the fan 56 would push air downwardly through the flue 26 and out of the air inlets 47.

A gate 68 is pivotably mounted in the housing 50 and is adjustable to restrict and open the air flow path from the fan 56 into the annular cavity of the housing 50. The more open the air flow path, the higher the downward pressure exerted by the fan 56 will be. Therefore, for a single-speed fan 56, the gate 68 setting determines the amount of downward pressure. Alternatively, the fan 56 may be a variable speed fan, in which case the downward pressure may be adjusted by adjusting the speed of the fan 56, and the gate 68 would not be necessary.

In one construction, the airflow apparatus 54 is automatically adjustable to vary the amount of the downward pressure, or airflow, to more effectively counteract the standby convection heat loss of the water heater 10. In order to eliminate or control the standby convection currents, the opposing airflow generated by the airflow apparatus 54 must precisely balance the standby convection currents. If the airflow and the standby convection currents are not balanced, one will overpower the other resulting in heat loss from the flue 26. For example, if the airflow apparatus 54 is providing a greater airflow than the standby convection currents, the airflow apparatus 54 will reverse the direction of the standby convection currents causing heat to be lost out the bottom of the combustion chamber 22. Alternatively, if the airflow apparatus 54 provides a lesser airflow than the standby convection currents, the standby convection currents will bypass the airflow apparatus 54 resulting in heat loss out of the flue 26. Therefore, to substantially eliminate heat loss for a given magnitude of standby convection currents, the magnitude of the airflow generated by the airflow apparatus 54 can be adjusted to precisely balance the standby convection currents.

The magnitude of the standby convection currents is dependent upon the temperature of the water stored within the tank 14. However, this temperature is not constant as the temperature of the water stored in the tank 14 varies during the operation of the water heater 10. For example, the magnitude of the standby convection currents increases when the water stored in the tank 14 is elevated and decreases when the water stored in the tank 14 is lowered. Because the magnitude of the standby convection currents is variable with the temperature of the stored water, the adjustability of the airflow apparatus 54 is preferred in order to adjust the magnitude of the generated airflow to respond to the changes in the magnitude of the standby convection currents to create a substantially stagnant state within the flue 26.

The water heater 10 also comprises a control system for the fan 56. With reference to FIG. 1, the control system includes a controller 69 operatively interconnected between the fan 56 and a pressure switch 70 mounted on the gas valve 44. When there is a call for heat, fuel flows through the gas valve 44 and to the burner 42. The pressure in the gas valve 44 opens the pressure switch 70, an electrical signal is relayed to the controller 69, and the controller 69 turns the fan 56 off. Alternatively, a temperature switch 74 (illustrated in broken lines in FIG. 1) may be operatively interconnected with the controller 69 and mounted at the upper end 38 of the flue 26. When the burner 42 fires, the flue gas temperature rises, thereby opening the temperature switch 74. An electrical signal is relayed to the controller 69, and the controller turns off the fan 56. Alternatively, if there is a sufficiently strong flow of products of combustion through the flue 26 during operation of the burner 42, and the fan 56 would not unduly restrict the flow of products of combustion out of the flue 26, the fan 56 may be operated at all times.

In another embodiment of the invention, the airflow apparatus 54 is operated during operation of the burner 42 to create a downdraft and back pressure that can be used to assist or replace the baffle 28. The baffle 28 increases pressure drop and residence time of the products of combustion in the flue 26 where heat is transferred to the water stored in the tank 14. The airflow apparatus 54 can be operated during operation of the burner 42 to create a downdraft and increase the residence time of the products of combustion within the flue, thereby potentially allowing removal of the baffle 28. Replacement of the baffle 28 is preferred because the baffle 28 is a fixed entity that cannot be varied during burner operation, whereas, as discussed above, the airflow apparatus 54 is capable of being adjusted to vary the baffle effect during different phases of burner operation to thereby optimize the burner operation.

In another aspect of the invention, an additional airflow apparatus 146 (FIG. 1) can be operated during operation of the burner 42 to mix air with the products of combustion from the combustion chamber prior to the mixture entering the catalytic converter 112. The addition of air to the products of combustion improves the effectiveness of the catalytic converter 112 during the operation of the burner 42 at startup.

Combustion products produce substances that are harmful to the environment. A catalytic converter 112 is an optional way to reduce the amount of harmful substances released to the environment. The catalytic converter 112 contains platinum, palladium, or some other element that speeds the conversion of unburned hydrocarbons and carbon monoxide into water and carbon dioxide. A catalytic converter 112 does not work effectively until it reaches a certain elevated temperature. In the absence of the elevated temperatures, the infusion of air by the airflow apparatus 146 improves the performance of the catalytic converter 112.

In addition to controlling the activation and deactivation of the airflow apparatus 54, the control system also automatically adjusts the magnitude of the airflow generated by the airflow apparatus 54. As discussed above, the magnitude of the standby convection currents is dependent upon the temperature of the water stored within the tank 14. Therefore, to accurately balance the standby convection currents, the magnitude of the airflow can be controlled based upon the temperature of the stored water. In one construction, the controller 69 adjusts the operation of the airflow apparatus 54 based upon the temperature of the stored water measured by a sensor such as a thermistor 114 (illustrated in broken lines in FIG. 1).

In other constructions, the magnitude of the airflow can also be controlled based on the temperature or velocity of the standby convention currents within the flue 26 because the temperature and rate of flow of the flue gases in the flue 26 during standby is directly proportional to the temperature of the flue wall which is in turn directly proportional to the temperature of the water in the tank 14. Due to this proportional relationship, the controller 69 can adjust the operation of the airflow apparatus 54 based on the temperature of the gases within the flue 26 measured by a sensor, such as temperature switch 74 or a thermistor. Alternatively, the controller 69 can adjust the operation of the airflow apparatus 54 based on the velocity of the standby convection currents within the flue measured by a sensor such as an anemometer 116 (shown in broken lines in FIG. 1).

In yet other constructions, the magnitude of the airflow can be controlled based on the setting of the gas valve 44. The gas valve 44 is adjusted to control the desired set temperature of the water within the tank 14. In light of this relationship, the controller 69 can adjust the operation of the airflow apparatus 54 based on the setting of the gas valve 44 measured by a sensor 118 (shown in broken lines in FIG. 1) such as a rotary rheostat, potentiometer, or the like.

It is desirable to use as little energy as possible to drive the fan 56. More specifically, the cost of driving the fan 56 should not exceed the cost savings associated with reducing standby heat loss from the flue 26. One way to reduce the cost of driving the fan 56 is to use a thermo-electric generator 75 (illustrated in broken lines in FIG. 1) that converts heat provided by the pilot burner 46 (FIG. 1) into electricity that drives the fan 56.

FIGS. 4–11 illustrate alternative versions of the novel damper assembly 48. Where elements in these figures are the same or substantially the same as the version described above, the same reference numerals are used.

Figure 4:
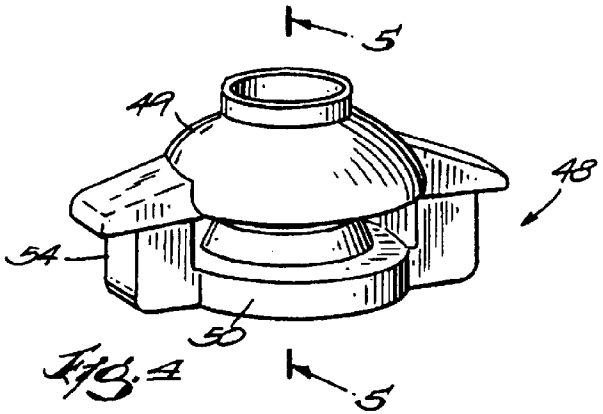
FIG. 4 is a perspective view of a second construction of the airflow apparatus.
Figure 5:
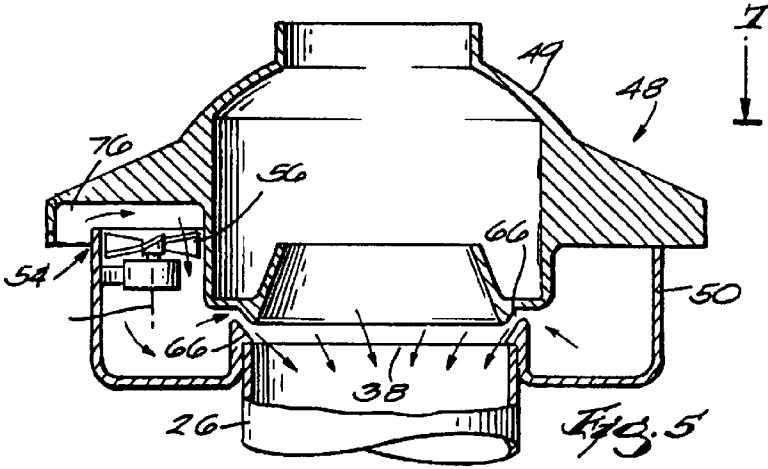
FIG. 5 is a cross-sectional view taken along line 5—5 in FIG. 4.

FIGS. 4 and 5 illustrate a second version of the damper assembly 48. In this version, the axis of rotation 58 of the tubeaxial fan 56 is vertically-oriented, and air is drawn upwardly under the hood 49 of the damper assembly 48, then downwardly through the fan 56 and into an annular cavity substantially identical to that described above. A portion of the hood 49 overhangs the fan 56 and defines a right angle entry channel 76 into the damper assembly 48. The air then follows a second right angle turn down through the fan 56, and a third right angle turn into the slots 66. The right angle turns may be slightly more or less than 90°.

The second version may also have similar control and power systems as described above, and may operate under the control of a similar controller 69. The second version may also employ a gate 68 or variable speed fan as described above with respect to the first version. As with the first version, a radial fan may be used in place of the tubeaxial fan 56 with some modifications to the housing 50. Because the fan 56 used in the first and second versions would cause a downward flow of air into the flue 26 in the absence of standby convection flow of flue gases, the first and second versions may be termed "circumferential downdraft" versions.

Figure 7:
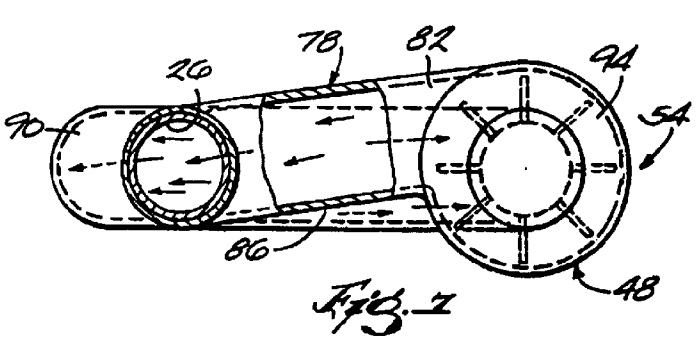
FIG. 7 is a cross-sectional view taken along line 7—7 in FIG. 6.
Figure 6:
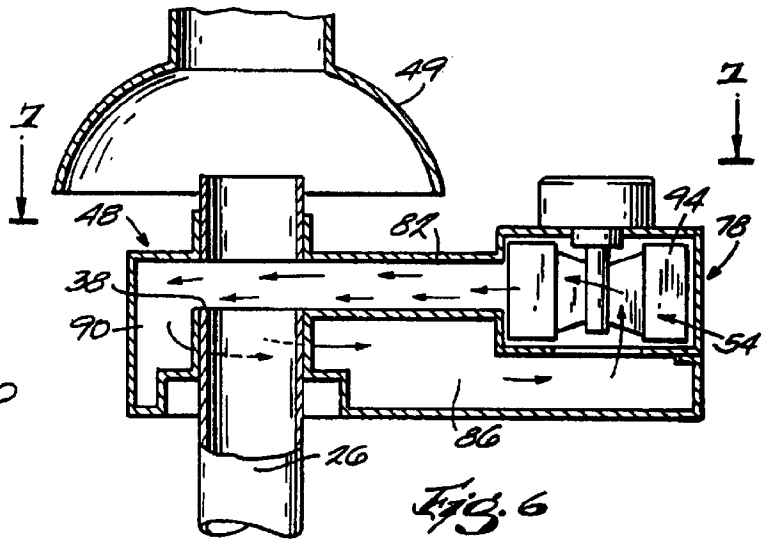
FIG. 6 is a cross-sectional view of a third construction of the airflow apparatus.

FIGS. 6 and 7 illustrate a third version of the damper assembly 48. This version may be termed an "air curtain" version. In this version, a housing 78 is mounted to the upper end 38 of the flue 26. The housing 78 includes first and second airflow chambers or ducts 82, 86 and a turn-around chamber 90. The chambers 82, 86, 90 communicate with each other and define a loop for airflow. A radial fan or blower 94 is in the first chamber 82.

During operation of the fan 94, air is drawn and pushed by the fan 94 from the second chamber 86, through the first chamber 82, across the upper end 38 of the flue 26, into the turn-around chamber 90, and back into the second chamber 86. The resulting curtain of air flowing across the upper end 38 of the flue 26 substantially prevents the flow of warm flue gases out of the upper end 38 of the flue 26 under the influence of standby convection alone. The third version may also have similar control and power systems as described above, and may operate under the control of a similar controller 69. The radial fan 94 of this version may be replaced with a tubeaxial fan with some modifications to the housing 78.

Figures 8, 9:
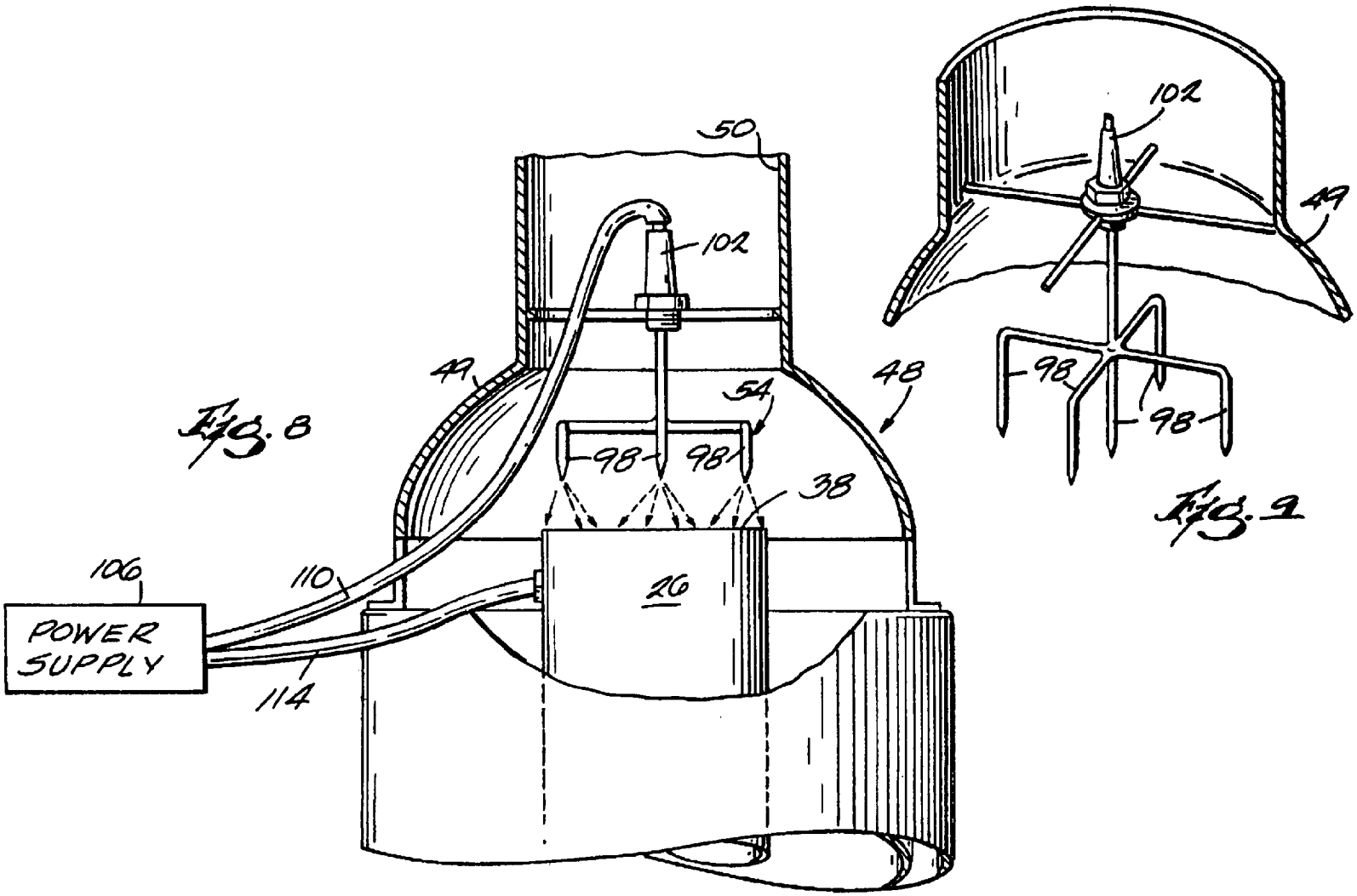
FIG. 8 is a partial section view of a fourth construction of the airflow apparatus.
FIG. 9 is a perspective view of the electrodes of the airflow apparatus shown in FIG. 8.

FIG. 8 illustrates a fourth version of the damper assembly 48. This version includes one or more first electrodes 98 having pointed ends. FIG. 9 illustrates one construction in which the first electrodes 98 include four electrodes 98 arranged in a square pattern with a fifth electrode 98 in the center of the square. It should be noted, however, that other numbers and configurations of electrodes 98 may be substituted for the illustrated arrangement. The fourth version is referred to herein as an "ionic airflow device".

The first electrodes 98 are connected to a device for providing electrical voltage, such as the illustrated spark plug 102. The spark plug 102 is interconnected with a power supply 106 by way of a conductive wire 110. It is preferable to supply DC power to the first electrodes 98, and the power supply 106 may therefore be a DC power source or an AC power source with a DC converter or an AC signal imposed on a DC power source. The power supply 106 is grounded to the flue wall by way of a grounding wire 114, and therefore a portion of the flue wall acts as a second electrode having a polarity opposite the first electrodes 98. There is therefore a high voltage difference between the first electrodes 98 and the flue wall. A voltage difference of 8–10 kV is preferable, but it may also be higher.

When the power supply 106 is actuated, a positive charge is applied to the first electrodes 98. The positive charge ionizes particles in the air around the first electrodes 98, and the ionized particles are drawn or attracted to the oppositely-charged flue wall. The pointed ends of the first electrodes 98 facilitate the creation of the ionized particles, and the relatively large size of the second electrode (i.e., the flue 26) ensures that the ionized particles will be attracted to the second electrode. The ionized particles are therefore biased for movement toward the flue wall, and bump into flue gas particles in or exiting the upper end 38 of the flue 26. This creates a downward pressure on the flue gases that substantially prevents the flue gases from escaping through the upper end 38 of the flue 26. The fourth version may therefore also be considered a downdraft damper.

Alternatively, the first electrodes 98 may be positioned to the side of the upper end 38 of the flue 26 and a second electrode or electrodes may be positioned on the other side of the upper end 38 such that a cross-flow of ionic wind is created across the upper end 38, resulting in an air curtain similar to that described above in the third version. The fourth version may also have similar control system as described above, and may operate under the control of a similar controller 69. In addition, the magnitude of the airflow generated by the fourth version can be adjusted by varying the magnitude of the voltage difference between the first and second electrodes.

Figure 10:
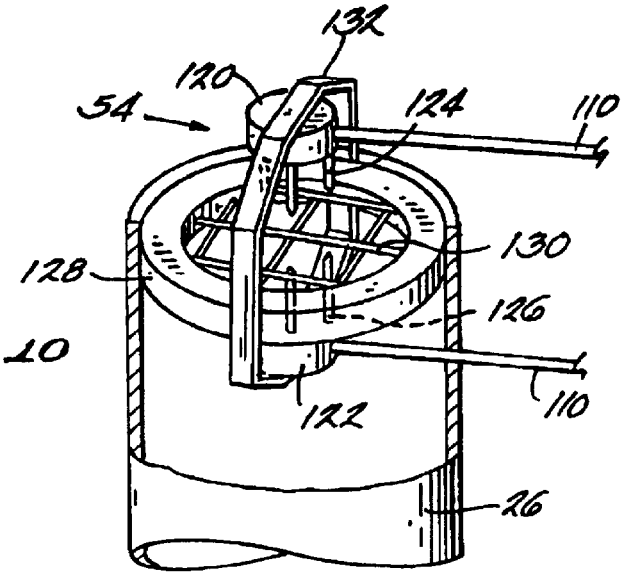
FIG. 10 is a perspective view of a fifth construction of the airflow apparatus.
Figure 11:
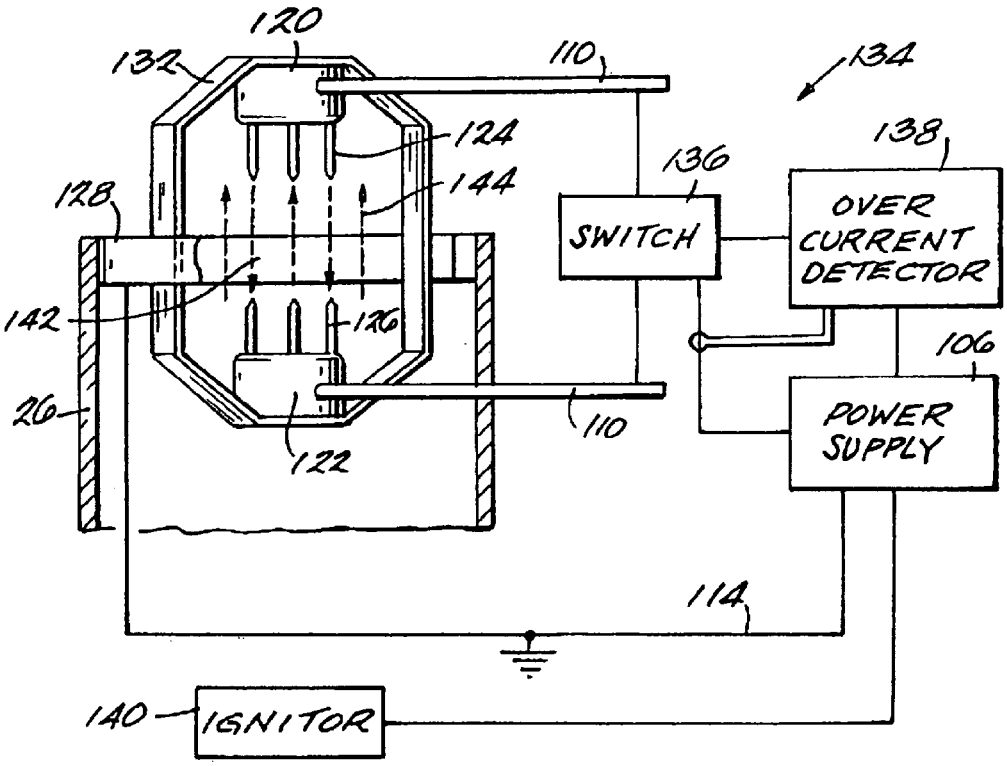
FIG. 11 is a partial schematic view of the water heater and the airflow apparatus shown in FIG. 10.

FIG. 10 illustrates a fifth version of the airflow apparatus 54, also referred to herein as an ionic airflow device. The ionic airflow device 54 is operable to direct air downward in the flue 26 during stand-by mode of the water heater 10 to counteract standby convection heat loss and is also operable to direct air upward to assist the exhaust of the products of combustion during the operation of the burner 42. This version includes first and second electrodes 120, 122 separated by a gap. The first electrode 120 includes pins 124 extending toward the second electrode 122, and the second electrode 122 includes pins 126 extending toward the first electrode 120. The ionic airflow device 54 also includes a third electrode 128 positioned within the gap between the first and second electrodes 120, 122. In this version, the third electrode 128 is a ring surrounding a screen 130, however the shape of the third electrode 128 and the presence of the screen 120 is not critical for the operation of the ionic airflow device 54. The first, second, and third electrodes 120, 122, 128 are connected by a bracket 132. FIGS. 10 and 11 illustrate one construction of the first and second electrodes 120, 122, in which the pins 124, 126 are arranged in triangular patterns. It should be noted, however, that other configurations of electrodes are known to those of ordinary skill in the art and can be substituted for the illustrated arrangement. For example, the first and second electrodes 120, 122 can be structurally similar to the third electrode 128.

As shown in FIG. 11, the first, second, and third electrodes 120, 122, 128 are connected to an electrical circuit 134. The electrical circuit 134 includes a power supply 106 and a switch 136 electrically connected to the power supply 106, preferably a DC power supply. The first and second electrodes 120, 122 are electrically connected to the switch 136 through conductive wires 110, and the switch 136 is operable to alternatively connect the first electrode 120 and the second electrode 122 to the power supply 106 depending upon the position of the switch 136. The third electrode 128 and the power supply 106 are grounded through a grounding wire 114. An over current device 138 is operably connected between the power supply 106 and the switch 136, and the power supply 106 is also electrically connected to an ignitor 140.

When the switch 136 is in a first position, the first electrode 120 is interconnected with the power supply 106 through the electrical circuit 134. The power supply 106 is grounded to the third electrode 128 by way of the grounding wire 114, and therefore the third electrode 128 has a polarity opposite the first electrode 120. There is therefore a high voltage difference between the first electrode 120 and the third electrode 128. A voltage difference of 5–10 kV is preferable, but it may also be higher.

When the power supply 106 is actuated, a positive charge is applied to the first electrode 120. The positive charge ionizes particles in the air around the pins 124 of the first electrode 120, and the ionized particles are drawn or attracted to the oppositely-charged third electrode 128. The pins 124 of the first electrode 120 facilitate the creation of the ionized particles, and the relatively large size of the third electrode 128 ensures that the ionized particles will be attracted to the third electrode 128. The ionized particles are therefore biased for movement toward the third electrode 128 (in the direction of arrows 142), and bump into flue gas particles in or exiting the upper end of the flue 26. This creates a downward pressure on the flue gases substantially preventing the flue gases from escaping through the upper end of the flue 26.

When the switch 136 is in a second position, the second electrode 122 is interconnected with the power supply 106 through the electrical circuit 134. The power supply 106 is grounded to the third electrode 128 by way of the grounding wire 114, and therefore the third electrode 128 has a polarity opposite the second electrode 122. There is therefore a high voltage difference between the second electrode 122 and the third electrode 128. A voltage difference of 5–10 kV is preferable, but it may also be higher.

When the power supply 106 is actuated, a positive charge is applied to the second electrode 122. The positive charge ionizes particles in the air around the pins 126 of the second electrode 122, and the ionized particles are drawn or attracted to the oppositely-charged third electrode 128. The pins 126 of the second electrode 122 facilitate the creation of the ionized particles, and the relatively large size of the third electrode 128 ensures that the ionized particles will be attracted to the third electrode 128. The ionized particles are therefore biased for movement toward the third electrode 128 (in the direction of arrows 144), and bump into flue gas particles in or exiting the upper end of the flue 26. This creates an upward pressure that substantially assists the flue gases to escape the flue 26. In this mode of operation, the ionic airflow device 54 operates as a blower unit.

Efficiency, heat transfer, and the amount of heat energy removed from the products of combustion in the flue 26 can be increased in a combustion system through elements that increase the pressure drop in the flue 26, such as the baffle 28. The baffle 28 increases turbulence, heat transfer area, and residence time, however the increase in pressure drop adversely affects the quality of the combustion unless there is compensation for the restriction caused by the baffle 28. When the second electrode 122 is powered, the ionic airflow device 54 acts as a blower to push or draw gas through the flue 26.

It should be noted that the ionic airflow device 54 may also include a similar control system as described above, and may operate under the control of a similar controller 69. The magnitude of the airflow generated by the ionic airflow device 54 can also be adjusted by varying the magnitude of the voltage difference between the first and third electrodes 120, 128 to adjust the magnitude of the downward airflow and between the second and third electrodes 122, 128 to adjust the magnitude of the upward airflow.

As best shown in FIG. 11, the over current device 138 disconnects power to the ionic airflow device 54 if the ionic airflow device 54 experiences an arcover event. The ionic airflow device 54 requires voltages of at least 5 kV and as high as 20 kV or greater. The electrical current can also be as low as 30 micro-amps or lower. The high voltages involved are capable of conducting through air over short distances on the order of 0.25 inches, which produces a spark. By using the over current device 138, in the occurrence of an arcover event, the over current device 138 detects an increase of current to the electrode 120, 122 and, in response, disconnects the power to the electrode 120, 122. The over current device 138 can also be used with the ionic airflow device 54 described as the fourth version of the airflow apparatus.

In the construction illustrated in FIG. 11, the ionic airflow device 54 is electrically connected to the same high-voltage power supply 106 that powers the ignitor 140 of a direct ignition system of the water heater 10. The ignitor 140 uses the high voltage power source 106 to create a spark, which ignites the burner 42 or intermittent pilot. This eliminates the need for a standing pilot and saves on fuel. By using a common power source for the ignitor 140 and the ionic airflow device 54, the need for a separate power supply for the ignitor 140 is eliminated. The ionic airflow device 54 described as the fourth version of the airflow apparatus can also share the same high voltage power source with an ignitor 140.

It should be noted that all versions of the illustrated apparatus for creating airflow are able to substantially prevent the flow of flue gases out of the flue 26 under the influence of standby convection without the use of a physical obstruction (e.g., a conventional solid damper valve) being placed over the upper end 38 of the flue 26.

What is claimed is:

1. An apparatus for heating a medium, the apparatus comprising:

a combustion chamber;

a burner within the combustion chamber and operable to create products of combustion for heating the medium to be heated;

a conduit for the exhaust of the products of combustion; and an airflow apparatus capable of creating airflow in the absence of any opposition to the airflow, the airflow having a pressure, the airflow apparatus communicating with the conduit and operable such that the pressure of the airflow resists standby convection flow of gases out of the conduit when the burner is not operating, and wherein the airflow apparatus is adjustable to vary the magnitude of the airflow to substantially equalize the airflow and the standby convection flow of gases to create a substantially stagnant state within the conduit when the burner is not operating.

2. The apparatus of claim 1, further comprising a water tank, wherein the medium to be heated is water in the water tank, and wherein the conduit includes a flue extending vertically through the water tank such that the hot products of combustion heat the water through the flue walls.

3. The apparatus of claim 1, wherein the airflow apparatus includes a gate at least partially restricting the airflow and wherein the magnitude of the airflow is varied by adjusting the gate.

4. The apparatus of claim 1, further comprising a power source adapted to supply power to the airflow apparatus, wherein the magnitude of the airflow is varied by adjusting the magnitude of the power supplied to the airflow apparatus by the power source.

5. The apparatus of claim 1, further comprising means for adjusting the airflow created by the airflow apparatus based on the temperature of the medium to be heated.

6. The apparatus of claim 1, further comprising means for adjusting the airflow created by the airflow apparatus based on the temperature of the gas within the conduit.

7. The apparatus of claim 1, further comprising means for adjusting the airflow created by the airflow apparatus based on the velocity of the standby convection flow of gases in the conduit.

8. The apparatus of claim 1, further comprising a fuel valve adjustable between settings to variably provide fuel to the burner, and further comprising means for adjusting the airflow created by the airflow apparatus based on the setting of the fuel valve.

9. The apparatus of claim 1, wherein the airflow apparatus includes a fan capable of rotating at a speed to create the airflow and wherein the magnitude of the airflow is varied by adjusting the speed of the fan.

10. The apparatus of claim 1, wherein the airflow apparatus includes first and second electrodes having opposite polarities and spaced from each other, the apparatus further comprising a power source interconnected between the first and second electrodes to create a voltage difference between the first and second electrodes, the first electrode creating ions, the ions being biased for movement toward the second electrode to generate the airflow, and wherein the magnitude of the airflow is varied by adjusting the voltage difference.

11. An apparatus for heating a medium, the apparatus comprising:

a combustion chamber;

a burner within the combustion chamber and operable to create products of combustion for heating the medium to be heated;

a conduit for the exhaust of the products of combustion; and an airflow apparatus capable of creating first airflow in the absence of any opposition to the first airflow, the first airflow having a first pressure, the airflow apparatus communicating with the conduit and operable such that the first pressure of the first airflow resists standby convection flow of gases out of the conduit when the burner is not operating, and wherein the airflow apparatus is also capable of creating a second airflow in the absence of any opposition to the second airflow, the second airflow having a second pressure, the airflow apparatus operable such that the second pressure of the second airflow assists the flow of gases out of the conduit when the burner is operating.

12. The apparatus of claim 11, further comprising a water tank, wherein the medium to be heated is water in the water tank, and wherein the conduit includes a flue extending vertically through the water tank such that the hot products of combustion heat the water through the flue walls.

13. The apparatus of claim 11, further comprising a power source adapted to supply power to the airflow apparatus, wherein the airflow apparatus includes first and second electrodes alternately connectable to the power source, and a third electrode positioned between the first and second electrodes, the third electrode having an opposite polarity to the first electrode when the power source supplies power to the first electrode thereby creating a voltage difference between the first and third electrodes, and wherein the first electrode creates ions that are biased toward the third electrode to create the first airflow.

14. The apparatus of claim 13, wherein the third electrode has an opposite polarity to the second electrode when power source supplies power to the second electrode thereby creating a voltage difference between the second and third electrodes, and wherein the second electrode creates ions that are biased toward the third electrode to create the second airflow.

15. The apparatus of claim 13, further comprising a switch that alternately connects the power source to the first and second electrodes.

16. The apparatus of claim 13, further comprising an over current device electrically connecting the airflow apparatus to the power source, the over current device electrically disconnecting the power source and the airflow apparatus when the airflow apparatus produces an arc-over event.

17. The apparatus of claim 13, wherein the power source is a DC power source.

18. The apparatus of claim 13, further comprising an ignitor positioned within the combustion chamber and adapted to intermittently generate a spark, wherein both the ignitor and the airflow apparatus are electrically connected to the power source.

19. The apparatus of claim 11, further comprising a catalytic converter communicating with the conduit, wherein the airflow apparatus communicates with a source of air outside of the conduit such that when the airflow apparatus assists the flow of gases out of the conduit when the burner is operating, the airflow apparatus adds air from the source of air to the products of combustion within the conduit when the burner is operating to increase the effectiveness of the catalytic converter.

* * * * *